United States Patent [19]

Capps

[11] Patent Number: 4,478,607

[45] Date of Patent: Oct. 23, 1984

[54] DEVICE FOR ATOMIZING AND DISPERSING FUEL IN A FUEL/AIR MIXTURE

[75] Inventor: Timothy L. Capps, Knoxville, Tenn.

[73] Assignee: Turra International, Inc., Atlanta, Ga.

[21] Appl. No.: 519,803

[22] Filed: Aug. 3, 1983

[51] Int. Cl.[3] ..... F02M 29/02; F02M 29/04

[52] U.S. Cl. ..... 48/189; 123/592; 123/593

[58] Field of Search ..... 123/592, 593; 48/189.5, 48/189.6

[56] References Cited

U.S. PATENT DOCUMENTS

| | | | |
|---|---|---|---|
| 1,051,369 | 1/1913 | Heath | 123/593 |
| 1,740,613 | 12/1926 | Lyle | 48/189.5 |
| 2,127,628 | 8/1938 | Hauser | 48/189.5 |
| 3,615,296 | 10/1971 | Guarnaschelli | 123/592 |
| 3,945,361 | 3/1976 | Piotrowicz | 48/189.5 |
| 4,011,850 | 3/1977 | Knox, Sr. | 123/592 |
| 4,014,303 | 3/1977 | Aiti | 123/592 |
| 4,059,082 | 11/1977 | McCauley | 123/593 |
| 4,153,028 | 5/1979 | Kumm et al. | 123/592 |
| 4,361,128 | 11/1982 | Goldman et al. | 123/592 |
| 4,399,800 | 8/1983 | Weindelmayer | 123/592 |

FOREIGN PATENT DOCUMENTS

| | | | |
|---|---|---|---|
| 461114 | 12/1913 | France | 48/189.5 |
| 359062 | 10/1931 | United Kingdom | 123/592 |
| 2052633 | 1/1981 | United Kingdom | 48/189.5 |

*Primary Examiner*—Ethel R. Cross

*Attorney, Agent, or Firm*—Dale Lischer; J. Rodgers Lunsford, III; William R. Cohrs

[57] ABSTRACT

There is disclosed a device for atomizing and dispersing fuel in a fuel/air mixture of the propeller type for an internal combustion engine. The housing of the device comprises two concentric barrels, each having a symmetrical bearing support. The barrels are press fit together to assure bearing alignment for the propeller. A downstream screen protects the engine from debris and further atomizes the fuel without substantially restricting fuel/air flow.

3 Claims, 5 Drawing Figures

DEVICE FOR ATOMIZING AND DISPERSING FUEL IN A FUEL/AIR MIXTURE

BACKGROUND OF THE INVENTION

This invention relates generally to devices for improving the efficiency of internal combustion engines and more particularly concerns an improved device for atomizing and dispersing the fuel in a fuel/air mixture within the intake manifold of an internal combustion engine.

It is known that if the fuel in the fuel/air mixture of an internal combustion engine is highly atomized and dispersed, the efficiency of the engine will be improved and objectionable emissions from the engine reduced. In a conventional internal combustion engine, fresh air is drawn through a carburetor by the vacuum created by the downward stroke of the engine's pistons. The air passes through a venturi and past an orifice through which liquid fuel is supplied. The airstream draws the liquid fuel from the orifice, and the fuel and air mix. The fuel and air mixture then passes the throttle plate of the carburetor, into the intake manifold, and into the open intake valve of each cylinder.

Conventional carburetors are not particularly good mixers of fuel and air. The resulting fuel particles in the fuel and air mixture may be of a relatively large size. During startup and slow idle, the fuel particles may actually coalesce and form puddles within the intake manifold thus further increasing the size of the fuel particles.

Many attempts have been made to reduce the size of the fuel particles and increase dispersion of the fuel in the fuel/air mixture in the intake manifold of internal combustion engines. The prior art discloses numerous devices including atomizers which purportedly decrease the fuel particle size and increase dispersion of the liquid fuel in the fuel/air mixture thereby improving the efficiency of the engine and reducing the emissions of the engine. Some prior art atomizers have consisted simply of screens or nonwettable plates within the fuel/air mixture stream. Other prior art atomizers have utilized a rotor or propeller which spins in response to the moving fuel/air mixture to further mix the fuel and air.

The prior art discloses numerous rotor and propeller-type atomizers including U.S. Pat. No. 4,153,028 issued to Kumm et al.; U.S. Pat. No. 4,014,306 issued to Ingersoll; U.S. Pat. No. 4,011,850 issued to Knox; U.S. Pat. No. 3,945,361 issued to Piotrowicz; U.S. Pat. No. 3,615,296 issued to Guarnaschelli; U.S. Pat. No. 3,544,290 issued to Larson et al.; U.S. Pat. No. 3,490,883 issued to Olivie; U.S. Pat. No. 3,283,482 issued to Trafford et al.; U.S. Pat. No. 1,153,077 issued to Hippel; and U.S. Pat. No. 1,051,369 issued to Heath.

In order, however, for a propeller-type atomizer to be practical, it is necessary for the atomizer to be long-lived, sturdy in construction, and simple to manufacture.

Bearing failure is a common problem for propeller-type atomizers. The propeller in the atomizer may spin at up to 5,700 rpm during operation. The fuel/air environment can cause lubrication failure. And the wide range of temperatures encountered can cause warping and bearing misalignment.

In order to extend bearing life, U.S. Pat. No. 3,615,269 to Guarnaschelli discloses the use of a second set of blades on the propeller that are reverse tilted in order to slow the speed of rotation.

Lubrication of the bearings for the propeller presents a formidable problem. The fuel droplets in the fuel/air mixture can penetrate into the bearing, dissolve most lubricants, and effectively flush the lubricants from the bearings. The result, of course, is premature bearing failure from lack of lubrication. Olivie, U.S. Pat. No. 3,490,883, specifically provides for a channel in one of the ends of the bearing to convey lubrication (such as ricinolic oil) to the bearing from outside of the manifold.

In modern engines, the temperature encountered in the intake manifold can vary from ambient to 700° F. during operation and to as much as 1600° F. shortly after the engine has been turned off. As a result, it is important to provide a housing that can resist the extremes in temperature without warping and thereby subjecting the bearings to excessive stresses during subsequent operation.

The housing and bearing support system of the atomizer must be constructed so that the bearings are properly and consistently aligned during assembly and rigidly supported during operation. Proper bearing alignment helps assure longer bearing life.

Finally, if the atomizer fails during operation, it is important to assure that the failed parts cannot be ingested into the engine causing damage to the engine. As a result, prior art propeller-type atomizers have had a substantial spiderweb-like grill at the downstream end to catch and hold the failed parts so that the pieces cannot be ingested into the automobile engine. Such a grill, however, creates a substantial restriction in the flow of the fuel/air mixture and thereby degrades engine performance.

SUMMARY OF THE INVENTION

It is therefore an object of the present invention to provide a propeller-type atomizer/fuel mixer having a bearing assembly that is long-lived.

It is a further object of the present invention to provide an atomizer/fuel mixer having a housing comprising machined concentric barrels or sleeves that are press fit together to insure proper and consistent alignment of the bearings for the propeller.

It is also an object of the present invention to provide fuel/air directing means on the upstream side of the atomizer to direct the fuel/air flow against the propeller to insure maximum speed and thereby maximum mixing of the fuel and air.

It is further an object of the present invention to provide a screen on the downstream side of the atomizer to protect the engine against ingesting any parts of the atomizer, to breakup further the fuel particles, and to create minimum restriction of the fuel/air flow,.

Other objects and advantages of the invention will become apparent upon reading the following detailed description and upon reference to the drawings.

DETAILED DESCRIPTION OF THE INVENTION

The invention will be described in connection with the preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
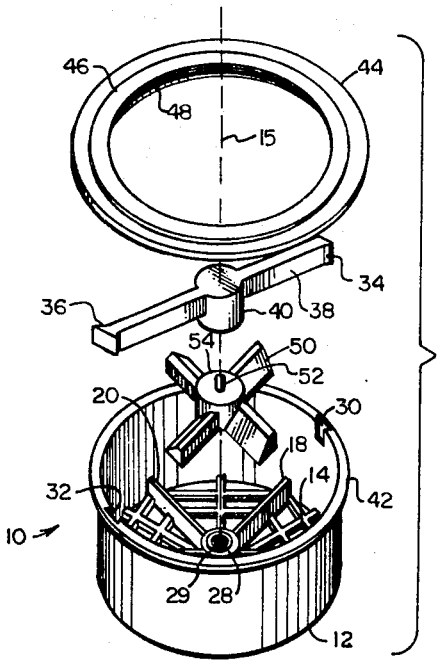
PRIOR ART FIG. 1
FIG. 1 is an exploded view of a prior art propeller-type atomizer/fuel mixer.
Figure 2:
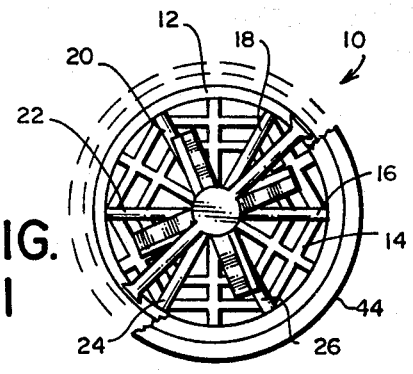
PRIOR ART FIG. 2
FIG. 2 is a top plan view of the same prior art atomizer/fuel mixer.

In order to understand the advantages of the present invention, it is necessary to describe the operation and construction of a prior art atomizer/fuel mixer 10 shown in FIGS. 1 and 2. Turning to FIG. 1, the prior art atomizer/fuel mixer 10 has a cylindrical housing 12, which is formed by casting, usually from zinc. During the casting, a spiderweb grill 14 is formed integrally at the bottom (downstream) of the housing 12. The radial members 16, 18, 20, 22, 24, and 26 (FIG. 2) of the grill meet at a central hub 28 which is aligned with the axis of symetry 15 of the cylindrical housing 12 and which supports a bottom bearing 29. The bottom bearing 29 is pressed into hub 28, and the bearing is intended to be aligned with the axis 15.

The housing 12 has dove-tailed slots 30 and 32 molded on opposite sides near its top (upstream). The dove-tailed slots 30 and 32 receive dove-tail portions 34 and 36 of cross member 38. The cross member 38 has a bearing support hub 40 aligned with axis 15. A top bearing (not shown) is press fit into the hub 40 and is intended to be aligned with the axis 15.

The housing 12 has a flange 42 extending around the top of its circumference. A clamping ring 44 has a top half 46 and a bottom half 48 which fit above and below the flange 42. The halves 46 and 48 of the clamping ring 44 are spot welded together around their circumference in order to clamp the dove-tail portions 34 and 36 of the cross member 38 into the dove-tail slots 30 and 32 to form dove-tail joints.

A propeller 50 has a shaft 52 pressed into its center hub 54. The shaft seats and rotates in the top and bottom bearings carried by bearing support hubs 28 and 40. The bearings and shaft are made of tungsten carbide steel which is actually lubricated by the fuel in the fuel/air mixture that passes through the device.

The propeller 50 has four blades each with a bevelled surface. When the fuel/air mixture passes through the atomizer/fuel mixer (from top to bottom of FIG. 1), the propeller 50 spins counterclockwise when viewed from the top in FIG. 2. As previously noted, the propeller's spinning causes the fuel to be more thoroughly atomized and mixed with the air thereby providing improved efficiency and minimizing emissions.

The prior art atomizer/fuel mixer shown in FIGS. 1 and 2 has several problems which during operation manifest themselves. First of all, because the housing is formed by casting, the tolerances can be held to only about 0.004 inches. That tolerance means that the dove-tail joints between the cross member 38 and the housing 12 can sometimes be rather loose. With the propeller spinning up to 5,700 rpm, the vibrations created can cause the cross member 38 to wobble at the dove-tailed joints thereby creating stresses adjacent the hub 40. In fact, in actual field tests, I have observed that the cross member 38 frequently cracks or breaks adjacent the hub 40.

The zinc used for the housing of prior art atomizer/fuel mixer has a high coefficient of thermal expansion, and after engine shutoff when temperatures can reach 1600° F., the housing can actually warp thus causing bearing misalignment and premature bearing failure.

Because of the failure rate of the prior art atomizer/fuel mixer, the spiderweb grill 14 was provided in the prior art device to insure that failed parts of the atomizer/fuel mixer cannot be ingested through the intake manifold of the automobile and into the engine. The spiderweb grill, however, creates a substantial restriction in the amount of fuel/air flow through the device. As a result, the device does not achieve the degree of increased performance that should result from increased atomization and dipersion of the fuel because of the restriction caused by the spiderweb grill. The configuration of the spiderweb grill may also contribute to the tendancy of the housing to warp when heated.

Assembly of the prior art atomizer/fuel mixer requires several welding operations in order to connect halves 46 and 48 of the clamping ring 44 together to clamp the cross member 38 to the housing 12. Having welds on a device that is subject to temperature stresses and vibration stresses increases the likelihood of material fatigue and failure.

Figure 3:
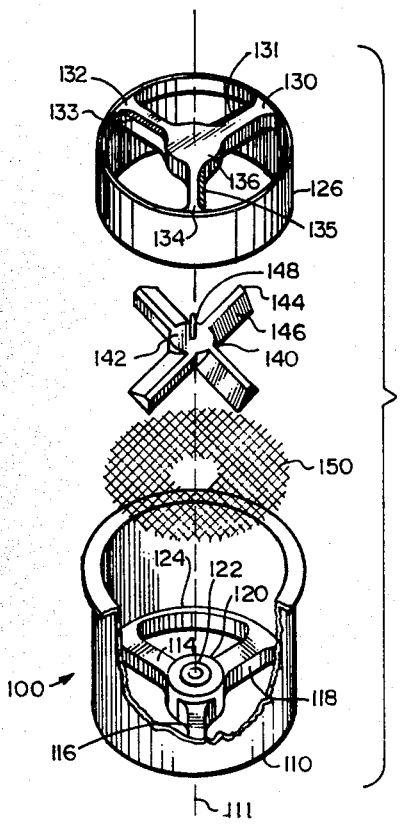
FIG. 3 is an exploded view of the atomizer/fuel mixer embodying the present invention.
Figure 4:
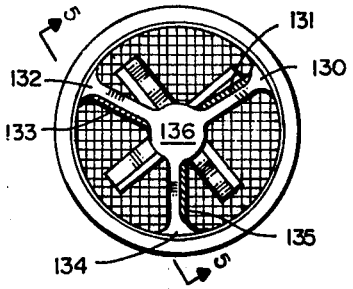
FIG. 4 is a top plan view of the atomizer/fuel mixer embodying the present invention.
Figure 5:
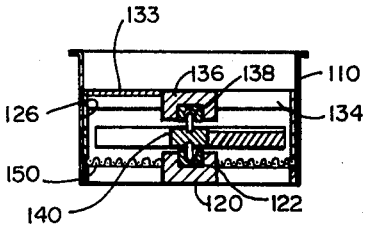
FIG. 5 is a section view of the atomizer/fuel mixer embodying the present invention as seen along line 5—5 of FIG. 4.

Having thus described the construction and operation of the prior art atomizer/fuel mixer, there is shown in FIGS. 3, 4, and 5, the preferred embodiment for an atomizer/fuel mixer 100 which embodies the principles of the present invention. The atomizer/fuel mixer 100 comprises an external cylindrical barrel 110 and an internal cylindrical barrel 126 both having an axis of symetry 111, bearing support means at the bottom and top of the two respective barrels, a propeller 140, and a screen 150.

The external cylindrical barrel 110 is machined from brass and has a bottom bearing support means formed during machining at its lower (downstream) end. The bearing support means includes annular ledge 124 and spokes 114, 116, and 118, which intersect at hub 120. The bearing support means is integral with the barrel. The hub 120 has a cylindrical recess for receiving a bottom bearing 122. The bottom bearing support means is symetrical to the axis 111 of the cylindrical barrel 110, and the bottom bearing 122 is mounted within the hub so that it is concentric with the axis 111 of the barrel 110.

The internal cylindrical barrel 126 is machined from brass with a top bearing support means formed during machining at its upper (upstream) end. The top bearing support means is integral with the internal cylindrical barrel and includes spokes 130, 132, and 134, which intersect at hub 136. The spokes 130, 132, and 134 each have a bevelled surface 131, 133, and 135 respectively. The hub 136 has a cylindrical recess for receiving a top bearing 138 (FIG. 5). The top bearing support means is symetrical to the axis 111, and the top bearing 138 is mounted within the hub so that it is concentric with the axis 111. The outside diameter of the internal barrel 126 is machined in order to be heated and press fit within the external barrel 110.

The propeller 140 of the atomizer/fuel mixer includes a hub 142 with four blades (144 for example) extending therefrom. Each blade 144 has a bevelled edge (146 for example) so that when the fuel air mixture passes through the atomizer/fuel mixer (top to bottom in FIG.

3), the propeller turns counterclockwise as viewed from the top of the atomizer/fuel mixer (FIG. 4). The hub 142 has a center hole drilled therein to receive in press fit fashion shaft 148. The ends of the shaft 148 are rounded and seat within bearings 138 and 122 each of which also have a rounded seat (FIG. 5). The shaft 148 and the bearings 122 and 138 are made of tungsten carbide steel.

Screen 150 is stainless steel and is seated on the annular ledge 124 and on spokes 114, 116, and 118 of the bottom bearing support means, within the external barrel 110, and on the downstream side of the propeller 140. The screen performs the dual functions of trapping any failed parts or other debris and further atomization of the fuel. Moreover, the screen 150 is an open mesh which, unlike the spiderweb of the prior art atomizer/fuel mixer, does not substantially restrict the flow of fuel/air through the device.

As can best be seen from FIG. 3, the atomizer/fuel mixer 110 is assembled by first placing the screen 150 on the upstream side of the bottom bearing support means. The shaft 148 of the propeller 140 is then seated in bearing 122. Finally, the internal barrel 126 is press fit into the external barrel 110 so that top bearing 138 carried by the top bearing support means engages the upper end of the propeller shaft 148.

Because the internal and external barrels are machined, instead of cast, the tolerances can be held closely in order to provide a snug press fit between the two and assure that the two pieces are concentric and symetric with each other about axis 111. As a result, during assembly the bearings 122 and 138 are consistently and accurately aligned with axis 111. The resulting accurate alignment of the bearings insures vibration-free rotation of the propeller.

The carbide steel shaft 148 and bearings 122 and 138 insure long bearing life, particularly in a fuel/air environment.

Because the device is machined from brass, the thicknesses of the spokes 114, 116, 118, 130, 132, and 134 can be minimized and still provide the necessary bearing support. Brass also has a low coefficient of expansion and can easily withstand the temperatures encountered at the intake manifold so that bearing alignment is not affected by temperature and thus stresses are not created within the bearings which would cause premature failure. Moreover, because the bearing support means, top and bottom, are integral with the internal and external barrels, there is virtually no chance of wobbling occurring such as with the dove-tail joints of the prior art.

The bevelled edges 131, 133, and 135 at the upstream inlet of the fuel/air mixture direct the flow of the fuel/air mixture against the propeller blades 144 to insure maximum propeller speed.

What is claimed is:

1. An atomizer/fuel mixer for atomizing and dispersing fuel in a moving fuel/air mixture comprising an external cylindrical barrel having an axis, first bearing support means integrally formed at one end of the external barrel symetric with the axis, and supporting a bearing aligned with the axis, an internal cylindrical barrel press fit within the external barrel and concentric therewith, second bearing support means integrally formed at one end of the internal barrel, symetric with the axis, and supporting a bearing aligned with the axis, a propeller with a shaft fit thereto and mounted for rotation between the bearings supported by the first and second bearing support means.

2. The atomizer/fuel mixer of claim 1, wherein a screen is mounted on the bearing support means which is downstream of the propeller.

3. The atomizer/fuel mixer of claim 1, wherein the second bearing support means includes inclined surfaces to direct the moving fuel/air mixture against the propeller.

* * * * *